US008205960B2

(12) United States Patent
Kusunoki

(10) Patent No.: US 8,205,960 B2
(45) Date of Patent: Jun. 26, 2012

(54) IMAGE FORMING APPARATUS

(75) Inventor: Masanori Kusunoki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 12/635,081

(22) Filed: Dec. 10, 2009

(65) Prior Publication Data

US 2010/0149253 A1 Jun. 17, 2010

(30) Foreign Application Priority Data

Dec. 17, 2008 (JP) ..... 2008-321021

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS 5,710,580 A * 1/1998 Otsuka et al. ..... 347/32
6,729,716 B2 5/2004 Eguchi et al.
7,249,816 B2 7/2007 Kusunoki et al.
7,494,205 B2 2/2009 Kusunoki et al.
7,621,608 B2 11/2009 Kusunoki et al.
2007/0206048 A1 9/2007 Kusunoki et al.

FOREIGN PATENT DOCUMENTS

JP 2738855 1/1998
JP 2008-126643 6/2008

* cited by examiner

*Primary Examiner* — Matthew Luu
*Assistant Examiner* — Justine Seo
(74) *Attorney, Agent, or Firm* — Cooper & Dunham LLP

(57) ABSTRACT

An image forming apparatus for forming an image includes a recording head, a nozzle, an ink repellent layer, and an elastic wiper blade. The nozzle is provided in the recording head and includes an ink discharge surface including a substantially elongated discharge opening from which ink is ejected. The ink repellent layer is formed on the ink discharge surface of the nozzle. The elastic wiper blade moves over the ink discharge surface to wipe away ink adhering to the ink discharge surface while slidably contacting the ink discharge surface. The wiper blade moves in a long axis direction of the ink discharge opening as the wiper blade wipes away ink adhering to the ink discharge surface of the nozzle.

7 Claims, 12 Drawing Sheets

NOZZLE INTERNAL PRESSURE: P

NOZZLE INTERNAL PRESSURE: P

NOZZLE INTERNAL PRESSURE: P

IMAGE FORMING APPARATUS

CROSS-REFERENCE TO RELATED APPLICATIONS

This patent application is based on and claims priority pursuant to 35 U.S.C. §119 from Japanese Patent Application No. 2008-321021, filed on Dec. 17, 2008 in the Japan Patent Office, which is hereby incorporated herein by reference in its entirety.

BACKGROUND OF THE INVENTION

1. Field of the Invention

Exemplary aspects of the present invention generally relate to an image forming apparatus using an ink jet method in which ink is ejected from a nozzle to form an image on a recording medium.

2. Description of the Background Art

There is known an image forming apparatus using an inkjet method in which ink is ejected from an opening of a nozzle onto a recording medium such as a sheet of paper to form an image thereon. The nozzle is generally provided to a recording head, which may contain a plurality of such nozzles.

In such an image forming apparatus, when ink is ejected from the nozzle, some ink adheres to the surface (ink discharge surface) on which the opening is formed, clogging the nozzle. In order to remove the ink and prevent such clogging, a wiper blade made of rubber is often used to wipe the ink from the ink discharge surface.

To solve this problem, an ink repellent layer can be provided to the ink discharge surface so as to make it difficult for the ink to remain there, thereby facilitating wiping away of the ink adhering to the ink discharge surface by the blade.

However, although effective, there is a drawback to the above-described approach. That is, as it moves, the blade deforms due to its elasticity, and a portion of the blade gets inside the nozzle from the tip. As the blade continues its wiping motion, a side surface of the blade frictionally contacts the ink repellent layer in the vicinity of the rim of the nozzle, damaging the ink repellent layer.

In particular, if the ink accumulates and hardens (agglutinates) on the ink discharge surface, the wiper blade wipes away the agglutinated product (ink), and then the agglutinated product sticks to the blade. The wiper blade with the agglutinated ink adhering thereto then rubs against the ink repellent layer in the vicinity of the rim of nozzle.

As a result, the agglutinated product acts like an abrasive agent that promotes damage of the ink repellent layer. When such wiping operation is repeatedly performed over time, the ink repellent layer in the vicinity of the rim of the nozzle in the direction in which the blade moves is worn away, thereby forming an area where ink easily adheres.

When an area substantially near the rim of the nozzle includes a portion where ink easily adheres as described above, the ink spreads over the portion where ink easily adheres to the rest of the rim of the nozzle as the ink is ejected from the nozzle and alters the direction in which the ink is ejected, thereby degrading imaging quality.

SUMMARY OF THE INVENTION

In view of the foregoing, in one illustrative embodiment of the present invention, an image forming apparatus for forming an image includes a recording head, a nozzle, an ink repellent layer, and an elastic wiper blade. The nozzle is provided in the recording head and includes an ink discharge surface including a substantially elongated discharge opening from which ink is ejected. The ink repellent layer is formed on the ink discharge surface of the nozzle. The elastic wiper blade moves over the ink discharge surface to wipe away ink adhering to the ink discharge surface while slidably contacting the ink discharge surface. The elastic wiper blade moves in a long axis direction of the ink discharge opening as the wiper blade wipes away ink adhering to the ink discharge surface of the nozzle.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1A:
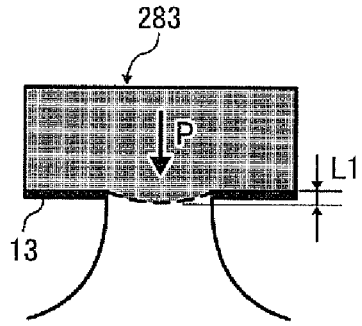
FIG. 1A is a cross-sectional schematic view taken along line A-A of FIG. 5A.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 2:
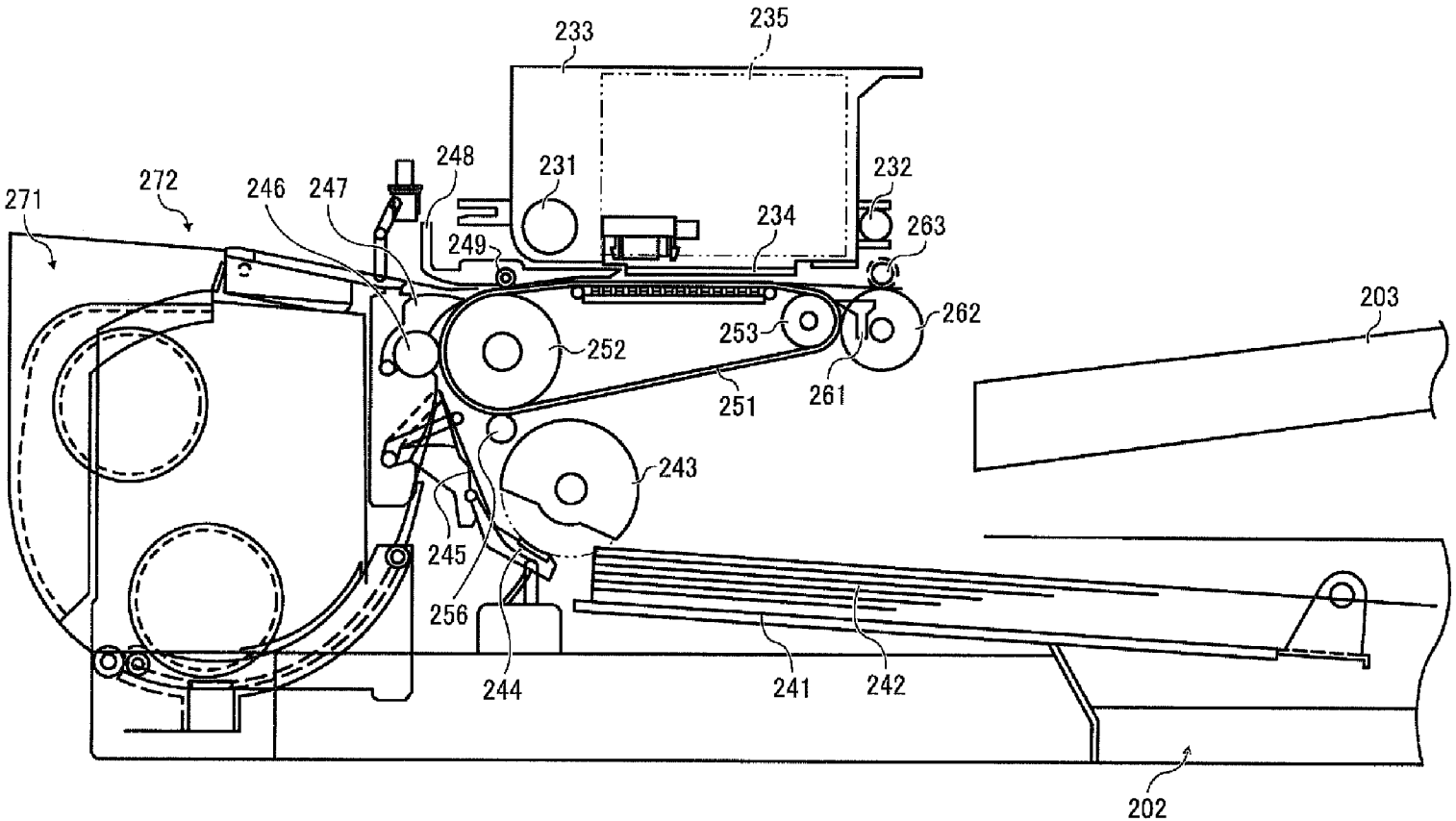
FIG. 2 is a schematic diagram illustrating an image forming apparatus according to an illustrative embodiment of the present invention.

Referring now to the drawings, wherein like reference numerals designate identical or corresponding parts throughout the several views, and initially to FIG. 2, one example of an image forming apparatus according to an illustrative embodiment of the present invention is described.

Embodiment 1

Figure 3:
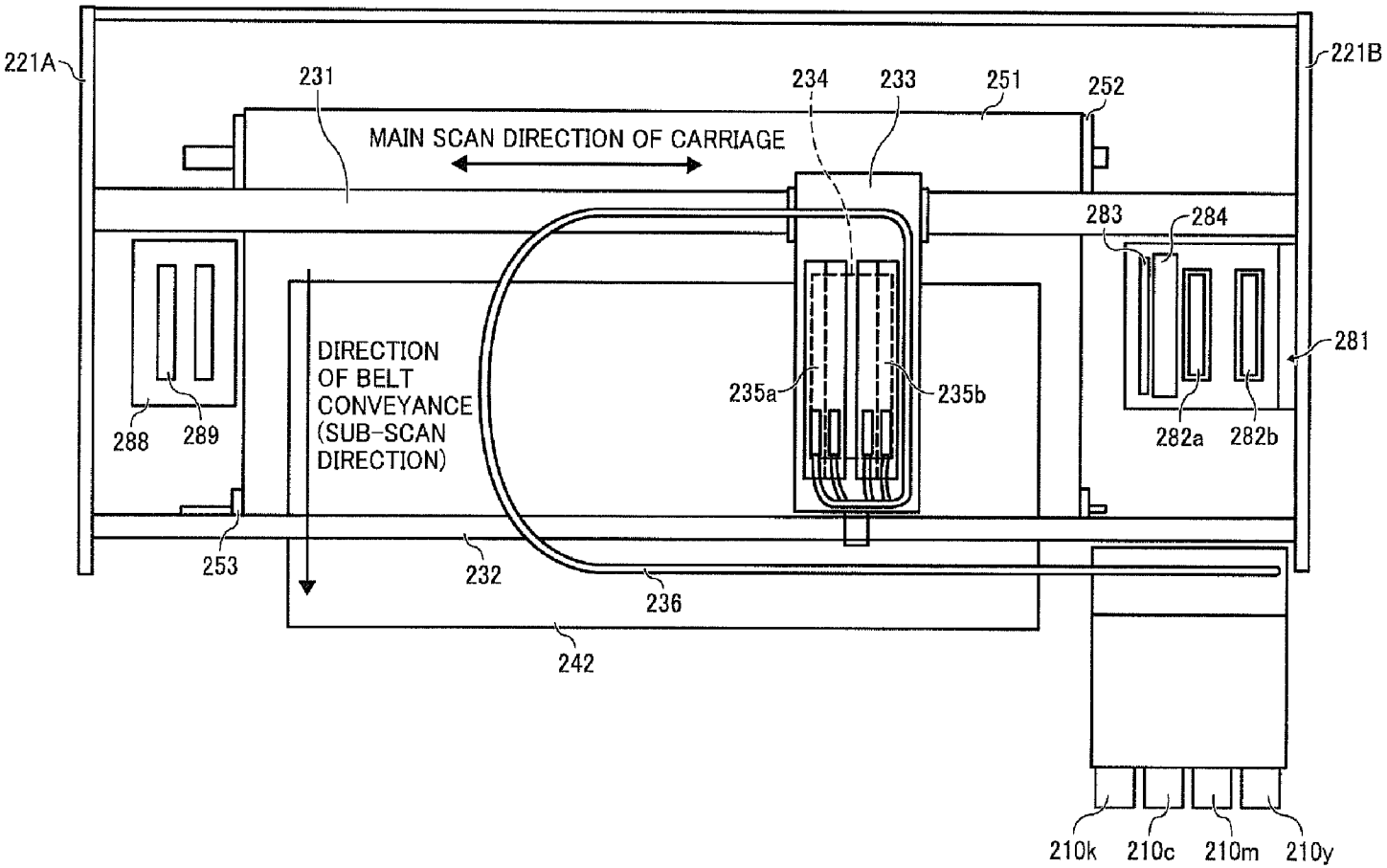
FIG. 3 is a plan schematic view of a key portion of the image forming apparatus of FIG. 2.

FIG. 2 is a schematic diagram illustrating a main structure of the image forming apparatus. FIG. 3 is a plan schematic view of a key portion of FIG. 2.

The image forming apparatus according to the illustrative embodiment is a serial-type image forming apparatus. As illustrated in FIG. 2, the image forming apparatus includes a carriage 233 held by a main guide rod 231 and a sub guide rod 232 each of which serves as a guide member. The carriage 233 is held such that the carriage 233 is slidably movable in a main scan direction of the carriage. As illustrated in FIG. 3, the main guide rod 231 and the sub guide rod 232 are disposed between left and right side plates 221A and 221B.

A main scan motor 410 (shown in FIG. 19) moves the carriage 233 via a timing belt in the direction of arrow which is the carriage main scan direction.

As illustrated in FIG. 3, the carriage 233 includes a recording head 234 including ink ejection heads for ejecting ink droplets of colors yellow (Y), cyan (C), magenta (M), and black (K). The recording head 234 is mounted on the carriage 233 such that ink droplets are ejected downward.

The carriage 233 includes sub tanks 235*a* and 235*b* for supplying ink of different colors in accordance with nozzle arrays of the recording head 234. It is to be noted that the sub tanks are simply referred to as 235 when no discrimination between the sub tanks 235*a* and 235*b* is necessary. Each color of ink is supplied from ink cartridges 210Y through 210K to the sub tanks 235 through supply tubes 236 of each color.

Referring back to FIG. 2, the image forming apparatus includes a sheet feed unit including a sheet feed tray 202 including a sheet stack portion or a pressing plate 241, a sheet feed roller 243, and a separation pad 244. The sheet feed tray 202 includes the sheet stack portion 241 on which a plurality of recording media sheets 242 is stacked. The recording media sheets 242 are separated and fed one sheet at a time from the sheet stack portion 241 by the sheet feed roller 243. The separation pad 244 is formed of material having a relatively large friction coefficient and faces the sheet feed roller 243. The separation pad 244 is urged toward the sheet feed roller 243.

In order to send the recording medium 242 fed from the sheet feed unit to the bottom of the recording head 234, the image forming apparatus includes a sheet guide member 245 that guides the recording medium 242, a counter roller 246, a transport guide member 247, a holding member 248 including a pressure member 249, and a transport belt 251 serving as a transport mechanism.

The transport belt 251 electrostatically suctions the recording medium 242 thereto and transports the recording medium 242 to the position opposite the recording head 234.

The transport belt 251 is an endless belt wound around and stretched between a transport roller 252 and a tension roller 253. The transport belt 251 is configured to travel in a belt conveyance direction (a sub-scan direction).

A charging roller 256 serving as a charging mechanism is provided to charge the surface of the transport belt 251. The charging roller 256 contacts the surface layer of the transport belt 251 and is rotated as the transport belt 251 rotates. When the transport roller 252 is rotated by a sub-scan motor 412 (shown in FIG. 19) through a timing belt, the transport belt 251 moves in the belt conveyance direction.

Further, the image forming apparatus includes a sheet discharge unit that discharges the recording medium 242 on which an image is recorded by the recording head 234. The sheet discharge unit includes a sheet discharge roller 262, a sheet discharge sub-roller 263, and a separation claw 261 that separates the recording medium 242 from the transport belt 251. Substantially below the sheet discharge roller 262, a sheet discharge tray 203 is disposed.

As illustrated in FIG. 1, a duplex unit 271 is detachably mounted on the back of the image forming apparatus. The duplex unit 271 receives the recording medium 242 that is returned to the duplex unit 271 in the direction opposite the rotation of the transport belt 251. The duplex unit 271 reverses the recording medium 242 and feeds the recording medium 242 between a counter roller 246 and the transport belt 251. The upper surface of the duplex unit 271 serves as a manual feed tray 272.

One side of the carriage 233 in the scan direction is a non-print region. A recovery mechanism 281 is disposed at the non-print region to maintain and recover the condition of the nozzles of the recording head 234.

The recovery mechanism 281 includes caps 282*a* and 282*b*, a wiper blade 283, and an ink receiver 284. The caps 282*a* and 282*b* cover each nozzle surface of the recording head 234. It is to be noted that the caps are simply referred to as 282 when no discrimination between the caps 282*a* and 282*b* is necessary. The wiper blade 283 is a blade member that wipes the nozzle surface.

An empty ejection is performed to eject liquid droplets that are not used for recording and the viscosity of which is increased. The ink receiver 284 receives the liquid droplets when the empty ejection is performed.

An ink recovery unit 288 is disposed at a non-print region at the other side of the carriage 233 in the scan direction. During recording, the viscosity of the ink increases so that the empty ejection is performed to eject the liquid droplets that are not used for recording. The ink recovery unit 288 is a container that recovers or receives the liquid droplets that are not used for recording and thus ejected during the empty ejection. The ink recovery unit 288 includes an opening 289 which is opened along the nozzle array direction of the recording head 234.

In such an image forming apparatus as illustrated in FIG. 2, the recording medium 242 is fed from the sheet feed tray 202 one sheet at a time, and the recording medium 242 being fed substantially vertically upward is guided by the sheet guide member 245. Then, the recording medium 242 is transported and sandwiched between the transport belt 251 and the counter roller 246. The front end of the recording medium 242 is guided by the transport guide member 247 to the pressure roller 249 which then presses the recording medium 242 against the transport belt 251. The direction of transport is switched by substantially 90 degrees.

A positive output and a negative output are alternately supplied to the charging roller 256. That is, an alternating voltage is supplied to the charging roller 256. Accordingly, the transport belt 251 is supplied with an alternating charging voltage pattern. In other words, the transport belt 251 is alternately charged with a positive and a negative charge in a predetermined width in a form of a band in the traveling direction, that is, in the sub-scan direction.

When the recording medium 242 is transported to the transport belt 251 alternately charged with the positive and the negative charges, the recording medium 242 is suctioned onto the transport belt 251 and transported in the sub-scan direction as the transport belt 251 travels.

The recording head 234 is driven according to image signals while the carriage 233 is moved, thereby ejecting ink droplets onto the recording medium 242 and recording an image for one line on the recording medium 242 while the recording medium 242 does not move. After the recording medium 242 is transported by a predetermined amount, recording of the next line is performed.

When receiving a recording completion signal or a signal indicating that the rear end of the recording medium 242 arrives at a recording region, the recording operation is finished, and the recording medium 242 is discharged onto the sheet discharge tray 203.

Figure 4:
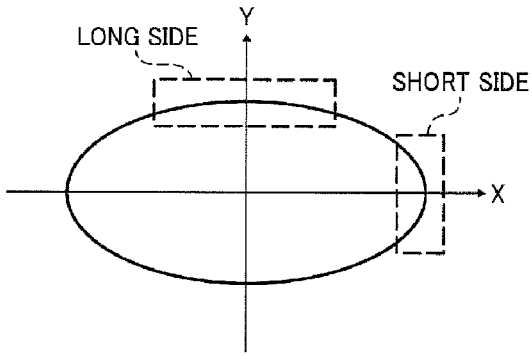
FIG. 4 is a schematic diagram illustrating an example of a shape of an ink discharge opening of a nozzle according to an illustrative embodiment of the present invention.

Referring now to FIG. 4, there is provided a schematic diagram illustrating one example of a shape of the ink discharge opening of the nozzle according to the illustrative embodiment of the present invention. According to the present embodiment, the ink discharge opening of the nozzle is a substantially elongated opening, for example an oval opening.

In FIG. 4, an area of the ink discharge opening within a dotted frame in an X-axis direction (in a long axis direction) is hereinafter referred to as a short side. An area of the ink discharge opening within a dotted frame in a Y-axis direction (in a short axis direction) is hereinafter referred to as a long side. As illustrated in FIG. 4, a curvature of the ink discharge opening at the short side is large. By contrast, the curvature of the long side is small.

Figure 5A:
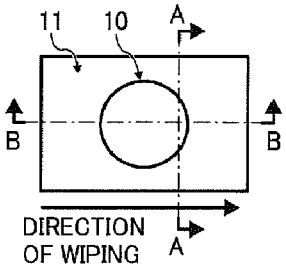
FIG. 5A is a schematic diagram illustrating a nozzle surface of a circular nozzle having a circular ink discharge opening.
Figure 5B:
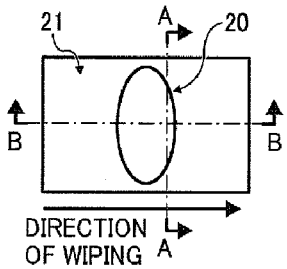
FIG. 5B is a schematic diagram illustrating a nozzle surface of an oval nozzle having an oval ink discharge opening, the long side of which faces the wiping direction of a wiper blade.
Figure 5C:
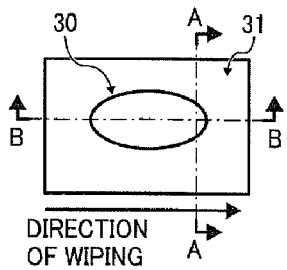
FIG. 5C is a schematic diagram illustrating a nozzle surface of an oval nozzle having an oval ink discharge opening, the short side of which faces the wiping direction of the wiper blade.

With reference to FIGS. 5A through 5C, a description is provided of discharge openings of different shapes. It is to be noted that an area of the openings illustrated in FIG. 5A through 5C is substantially the same.

FIG. 5A is a schematic diagram illustrating a nozzle surface of a generally-known circular nozzle having a circular discharge opening. FIG. 5B is a schematic diagram illustrating a nozzle surface of an oval nozzle having an oval discharge opening. The long side of the ink discharge opening faces the wiping direction of the wiper blade. FIG. 5C is a schematic diagram illustrating an oval discharge opening of the nozzle. The short side of the ink discharge opening faces the wiping direction of the wiper blade.

In FIG. 5A, a circular discharge opening is formed on a nozzle surface 11 of a circular nozzle 10.

In FIG. 5B, an oval discharge opening is formed on a nozzle surface 21 of an oval nozzle 20 such that the long side of the oval discharge opening faces the wiping direction of the wiper blade 283.

In FIG. 5C, an oval discharge opening is formed on a nozzle surface 31 of an oval nozzle 30 such that the short side of the oval discharge opening faces the wiping direction of the wiper blade 283.

Although not illustrated, an ink repellent layer such as a film that contains silicone resin or the like having a water-shedding property is provided on the nozzle surfaces 11, 21, and 31.

Figure 1B:
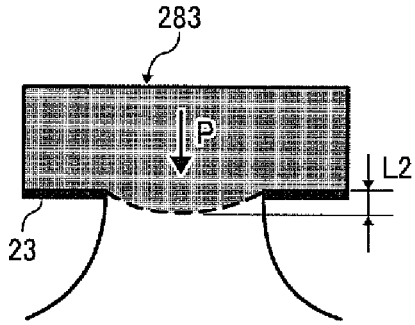
FIG. 1B is a cross-sectional schematic view taken along line A-A of FIG. 5B.
Figure 1C:
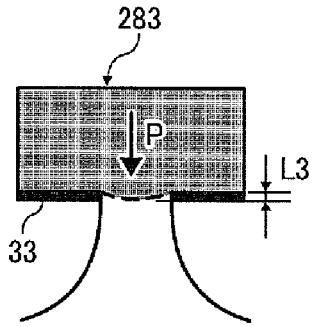
FIG. 1C is a cross-sectional schematic view taken along line A-A of FIG. 5C.

FIG. 1A is a cross-sectional schematic view taken along line A-A of FIG. 5A. FIG. 1B is a cross-sectional schematic view taken along line A-A of FIG. 5B. FIG. 1C is a cross-sectional schematic view taken along line A-A of FIG. 5C. L1 of FIG. 1A, L2 of FIG. 1B, and L3 of FIG. 1C indicate an amount of protrusion of the wiper blade 283 from the ink repellent layer into the nozzles when the wiper blade 283 contacts each nozzle surface with a same pressure P.

Figure 6A:
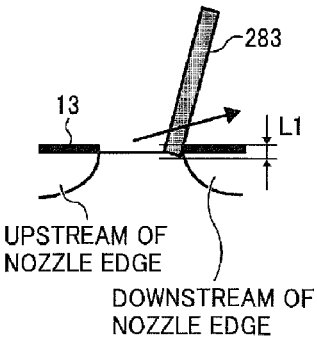
FIG. 6A is a cross-sectional schematic view taken along line B-B of FIG. 5A.
Figure 6B:
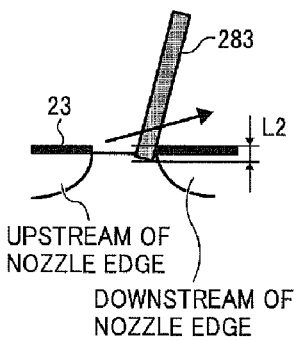
FIG. 6B is a cross-sectional schematic view taken along line B-B of FIG. 5B.
Figure 6C:
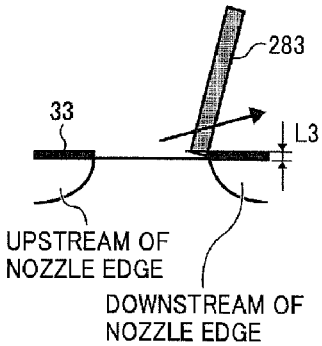
FIG. 6C is a cross-sectional schematic view taken along line B-B of FIG. 5C.

FIG. 6A is a cross-sectional schematic view taken along line B-B of FIG. 5A. FIG. 6B is a cross-sectional schematic view taken along line B-B of FIG. 5B. FIG. 6C is a cross-sectional schematic view taken along line B-B of FIG. 5C.

As illustrated in FIGS. 1 and 6, the relation of the amount of protrusion L1, L2, and L3 is expressed as L2>L1>L3 due to elasticity of the wiper blade 283. As illustrated in FIG. 5C, when the short side of the ink discharge opening of the oval nozzle 30 faces the wiping direction of the wiper blade 283, the amount of protrusion of the wiper blade 283 is the smallest. In other words, the larger the curvature of the ink discharge opening of the nozzle is, the smaller the amount of the protrusion of the wiper blade becomes.

As described above, when the amount of protrusion is small, that is, when the curvature of the ink discharge opening of the nozzle is large, the duration of the wiper blade 283 slidably contacting the ink repellent layer of the nozzle edge at the downstream side can be reduced as the wiper blade 283 moves slidably contacting the ink repellent layer in the direction of arrows in FIGS. 6A through 6C.

Accordingly, because the duration of slidable contact between the ink repellent layer of the nozzle edge of the downstream side and the wiper blade 283 is reduced, deterioration of the ink repellent layer can be reduced, if not prevented entirely.

Embodiment 2

Figure 7A:
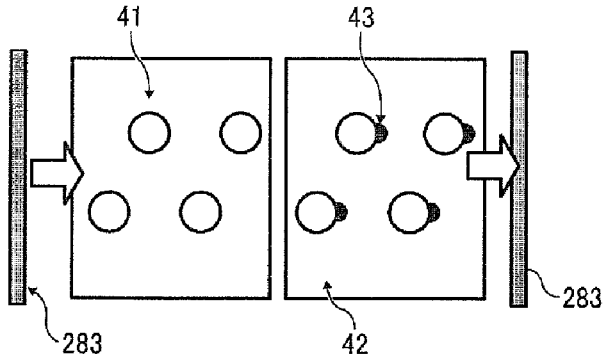
FIG. 7A is a schematic diagram illustrating a wiping operation when a plurality of circular nozzles of FIG. 5A is disposed.
Figure 7B:
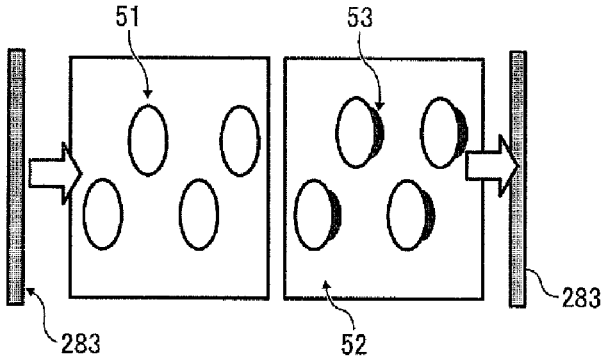
FIG. 7B is a schematic diagram illustrating the wiping operation when a plurality of oval nozzles of FIG. 5B is disposed.
Figure 7C:
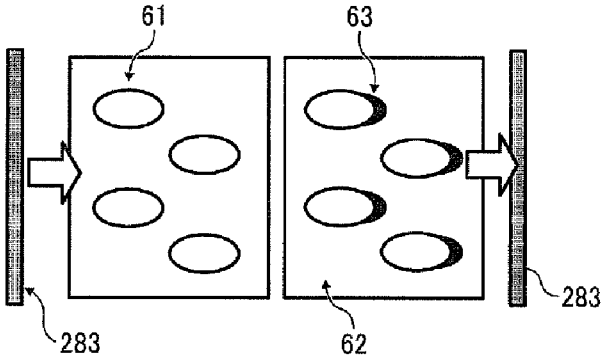
FIG. 7C is a schematic diagram illustrating the wiping operation when a plurality of circular nozzles of FIG. 5C is disposed.

Referring now to FIGS. 7A through 7C, a plurality of the nozzles of FIG. 5A through 5C is arranged and wiped. FIG. 7A is a schematic diagram illustrating an abraded area 43 of the ink repellent layer of circular nozzles 41 when a plurality of the circular nozzles 41 corresponding to FIG. 5A is arranged and wiped multiple times. FIG. 7B is a schematic diagram illustrating an abraded area 53 of the ink repellent layer of oval nozzles 51 when a plurality of the oval nozzles 51 corresponding to FIG. 5B is arranged and wiped multiple times. FIG. 7C is a schematic diagram illustrating an abraded area 63 of the ink repellent layer of oval nozzles 61 when a plurality of the oval nozzles 61 corresponding to FIG. 5C is arranged and wiped multiple times.

As can be seen in FIGS. 7A through 7C, the abraded areas of the ink repellent layer are formed substantially at the downstream side in the wiping direction of the wiper blade 283, that is, in the vicinity of the nozzle edge at the downstream side.

Figure 8:
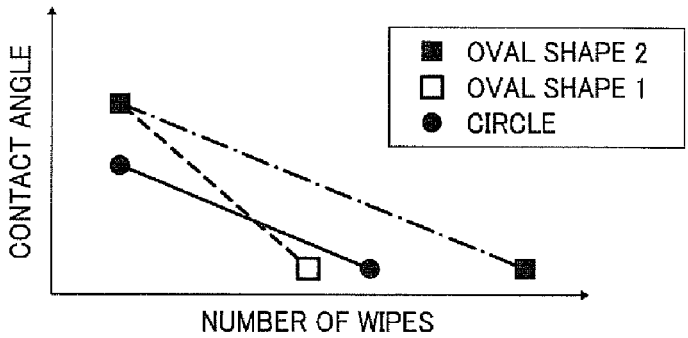
FIG. 8 is a graph showing a relation of a number of wipes and a contact angle in an area where an ink repellent layer is abraded.

Referring now to FIG. 8, there is provided a graph showing a relation of a number of times the wiper blade wipes and a contact angle in the abraded areas of the ink repellent layer when the plurality of nozzles are arranged and wiped by the wiper blade 283. It is to be noted that OVAL SHAPE 1 is a case in which the nozzles or the ink discharge opening of the nozzles are provided as illustrated in FIG. 7B. OVAL SHAPE 2 is a case in which the nozzles or the ink discharge opening of the nozzles are provided as illustrated in FIG. 7C.

As described with reference to FIGS. 1 and 6, when the duration of slidable contact between the wiper blade 283 and the ink repellent layer for a single wiping operation is long, a reduction rate of the contact angle (=an amount of reduction in the contact angle/a number of wipes) is significant. By contrast, when the duration of slidable contact between the wiper blade 283 and the ink repellent layer for a single wiping operation is short, the reduction rate of the contact angle is small.

As can be seen in FIG. 8, the number of wipes required for the contact angles to become the same size is the greatest when the nozzles are arranged as illustrated in FIG. 7C. Therefore, compared with the configurations as illustrated in FIGS. 7A and 7B, when the nozzles are arranged as illustrated in FIG. 7C, ink can be reliably ejected from the ink discharge opening for an extended period of time.

[Variation]

Figure 9A:
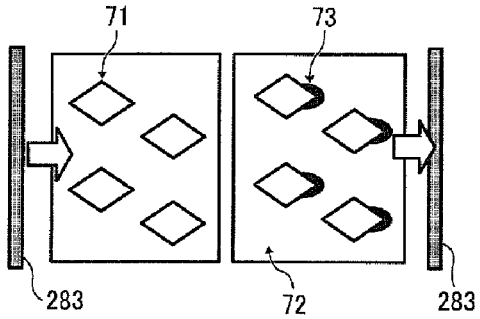
FIG. 9A is a schematic diagram illustrating the ink discharge openings having a rhomboid shape, the short side of which faces the wiping direction.
Figure 9B:
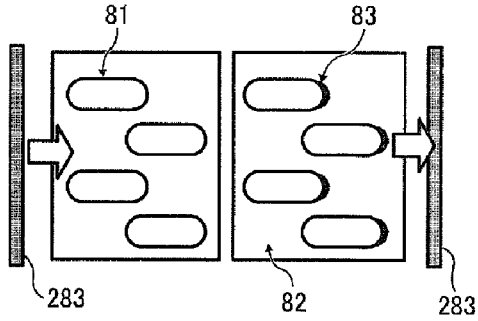
FIG. 9B is a schematic diagram illustrating the ink discharge openings having a rounded-slot shape, the short side of which faces the wiping direction.

Referring now to FIGS. 9A and 9B, a description is provided of an example of the ink discharge opening of the nozzles arranged in a manner as illustrated in FIG. 7C when the shape of the ink discharge opening of the nozzles is other than oval.

FIG. 9A is a schematic diagram illustrating the ink discharge opening of the nozzles having a rhomboid shape arranged such that the short side of the ink discharge opening faces the wiping direction of the wiper blade 283.

FIG. 9B is a schematic diagram illustrating the ink discharge opening of the nozzles having a rounded-slot shape, arranged such that the short side of the ink discharge opening faces the wiping direction of the wiper blade 283.

With the configurations illustrated in FIGS. 9A and 93, the similar, if not the same effect as that of FIG. 7C can be achieved.

Figure 10A:
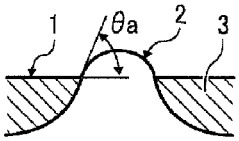
FIG. 10A is a cross-sectional schematic view through a Y-axis of FIG. 4.
Figure 10B:
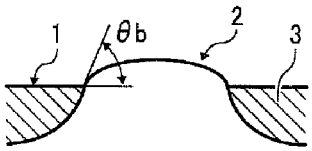
FIG. 10B is a cross-sectional schematic view through an X-axis of FIG. 4 when a meniscus is maintained.
Figure 10C:
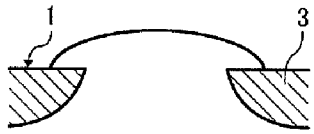
FIG. 10C is a cross-sectional schematic view through the X-axis of FIG. 4 when the meniscus is broken.

FIGS. 10A through 10C are cross-sectional schematic views illustrating a meniscus formed when a positive pressure is applied as a nozzle internal pressure P to the oval discharge opening shown in FIG. 4.

FIG. 10A is a cross-sectional schematic view through a Y-axis of FIG. 4. FIGS. 10B and 10C are cross-sectional schematic views through an X-axis of FIG. 4.

In FIG. 10A, a θa represents a contact angle between a nozzle surface 1 at the long side of the ink discharge opening and a meniscus 2 of ink curved from the ink discharge opening toward outside.

In FIG. 10B, the meniscus is maintained. A θb represents a contact angle between a nozzle surface 1 at the short side of the ink discharge opening and a meniscus 2 of ink curved from the ink discharge opening to the outside.

By contrast, in FIG. 10C, the meniscus is broken.

Figure 10D:
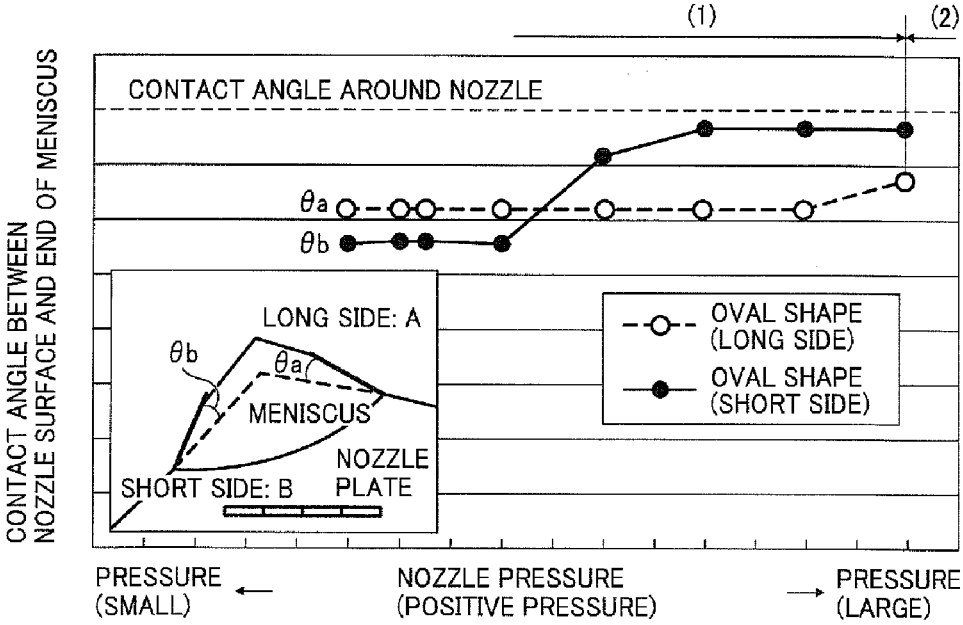
FIG. 10D is a graph showing changes in contact angles θa and θb when a nozzle internal pressure P is changed.

FIG. 10D is a graph illustrating changes in the contact angles θa and θb as the nozzle internal pressure P is changed.

As illustrated in FIG. 10D, when the nozzle internal pressure P is relatively small, the contact angle θa increases and becomes greater than the contact angle θb as the nozzle internal pressure P increases. When the nozzle internal pressure P reaches a certain pressure, this relation is reversed. That is, the contact angle θb becomes greater than the contact angle θa.

As the nozzle internal pressure P increases, both the contact angle θa and θb gradually become a similar contact angle (the contact angle of the ink relative to the nozzle surface) around the nozzle. As long as the nozzle internal pressure P is within an area (1) of FIG. 10D, the meniscus 2 is maintained at the nozzle edge as illustrated in FIG. 10B.

By contrast, when the nozzle internal pressure p exceeds the area (1) into an area (2), the meniscus 2 cannot stay at the nozzle edge, and the ink spreads over a nozzle plate 3 as illustrated in FIG. 10C.

In view of the above, according to the illustrative embodiment, the threshold nozzle pressure P of the area (1) and the area (2) is referred to as a positive pressure meniscus retaining force. When the positive pressure meniscus retaining force decreases, the ink spreads over the nozzle plate 3 at the time of ink ejection. This is called "drip". When this happens, the ejection direction of ink ejected from the ink discharge opening is undesirably alterd.

As can be understood from FIGS. 10A through 10D, when the curvature of the ink discharge opening differs in the perpendicular direction (the X-Y direction in FIG. 4) such as an oval shape, the positive pressure meniscus retaining force is determined at the portion of the ink discharge opening having a large curvature, that is, the short side of the oval discharge opening.

Figure 11:
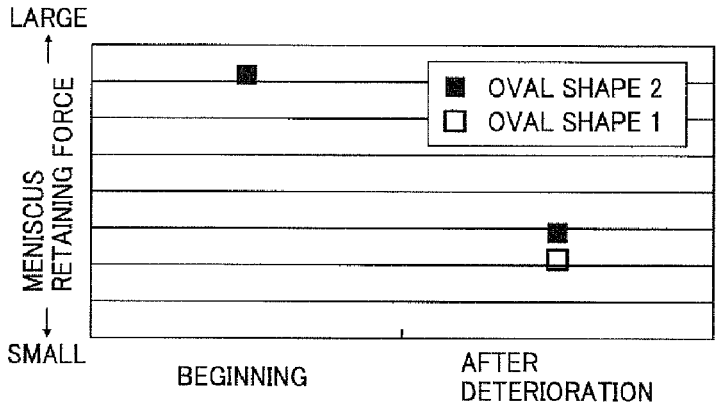
FIG. 11 illustrates a meniscus retaining force before wiping (at the beginning of wiping) and after an ink repellent layer is deteriorated.

FIG. 11 is a graph showing the contact angle and a meniscus retaining force before wiping (at the beginning of wiping) and after wiping, when the plurality of nozzles are arranged in a manner as illustrated in FIGS. 7B and 7C. FIG. 11 shows the meniscus retaining force when the size of the contact angle of the abraded area in the ink repellent layer of FIG. 7B coincides with the contact angle of the abraded area in the ink repellent layer of FIG. 7C (after deterioration of the ink repellent layer)

An OVAL SHAPE 1 in FIG. 11 refers to the case in which the ink discharge openings of the nozzles are disposed as illustrated in FIG. 7B. An OVAL SHAPE 2 refers to the case in which the ink discharge openings of the nozzles are disposed as illustrated in FIG. 7C.

As can be understood from FIG. 11, before wiping or at the beginning of wiping, the meniscus retaining force is the same when the nozzles are arranged as illustrated in FIG. 7B and FIG. 7C. By contrast, after wiping or after deterioration of the ink repellent layer, with the configuration shown in FIG. 7C, the meniscus retaining force is greater than that of the configuration shown in FIG. 7B.

Embodiment 3

Figure 12A:
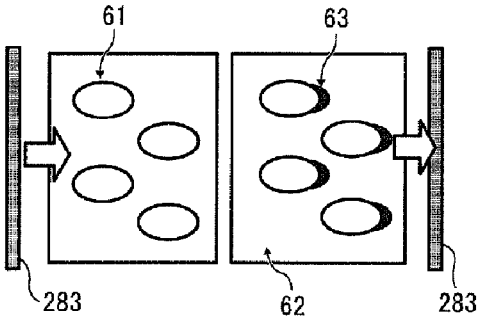
FIG. 12A is a schematic diagram illustrating the ink discharge openings when the direction of wiping is one way in the long axis direction of the ink discharge openings.
Figure 12B:
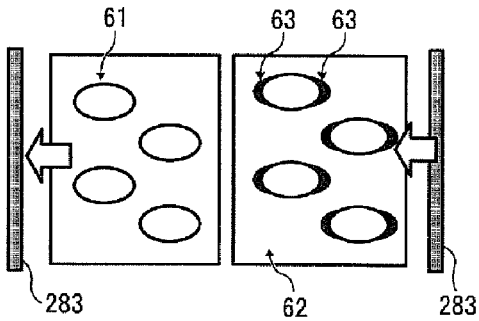
FIG. 12B is a schematic diagram illustrating the ink discharge openings when the direction of wiping includes two directions.

Referring now to FIGS. 12A and 12B, a description is provided of how the ink repellent layer is abraded when the direction of wiping of the wiper blade 283 is changed. FIG. 12A is a schematic diagram illustrating the ink discharge openings of the nozzles when the direction of wiping is one way in the long axis direction. FIG. 12B is a schematic diagram illustrating the ink discharge openings of the nozzles when the direction of wiping includes two directions.

As previously described with reference to FIGS. 10A through 10D and so forth, the meniscus retaining force depends on an absolute value of the contact angle. Therefore, when there is a place around the nozzle edge where the absolute value of the contact angle is small, the meniscus is destroyed from that place.

If the absolute value of the contact angle around the nozzle edge is prevented from getting reduced, that is, if the deterioration of the ink repellent layer around the nozzle edge is minimized, the meniscus retaining force can be prevented from decreasing.

In FIG. 12A, the wiper blade 283 moves in one direction in the long axis direction of the ink discharge opening. In other words, during wiping, the wiper blade 283 moves only in one direction from the left to the right in FIG. 12A.

In FIG. 12B, the wiper blade 283 moves in two directions in the long axis direction of the ink discharge opening. In other words, during wiping, the wiper blade 283 moves from the left to the right and from the right to the left.

As illustrated in FIG. 12B, when the wiper blade 283 moves to wipe the nozzles in two directions in the long axis direction of the ink discharge opening, the ink repellent layer around the nozzle edge at both ends of the ink discharge opening of the nozzles in the long axis direction is abraded, forming an abraded area 63.

As previously described with reference to FIG. 6, considering the fact that the ink repellent layer of the nozzle edge at the downstream side in the direction of wiping of the wiper blade 283 is abraded, when the wiper blade 283 moves in two directions in the long axis direction of the ink discharge opening, the number of times the wiper blade wipes one end of the ink discharge opening in the long axis direction can be reduced by half. In other words, the total number of wipes of the nozzle edges at both ends of the ink discharge opening can be split by half.

Figure 12C:
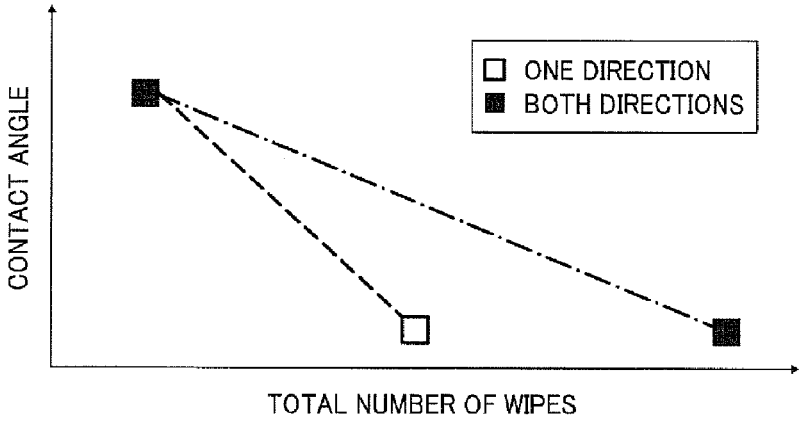
FIG. 12C is a graph showing a relation of the contact angle and the total number of wipes when the wiping direction is one way and both ways.

Accordingly, as illustrated in FIG. 12C, when the wiping direction of the wiper blade 283 includes two directions in the long axis direction of the ink discharge opening of the nozzle, the reduction rate of the contact angle, that is, the amount of reduction in the contact angle divided by the number of wipes (=an amount of reduction of the contact angle/the number of wipes), can be reduced more than when wiping in only one direction in the long axis direction of the ink discharge opening.

Figure 13:
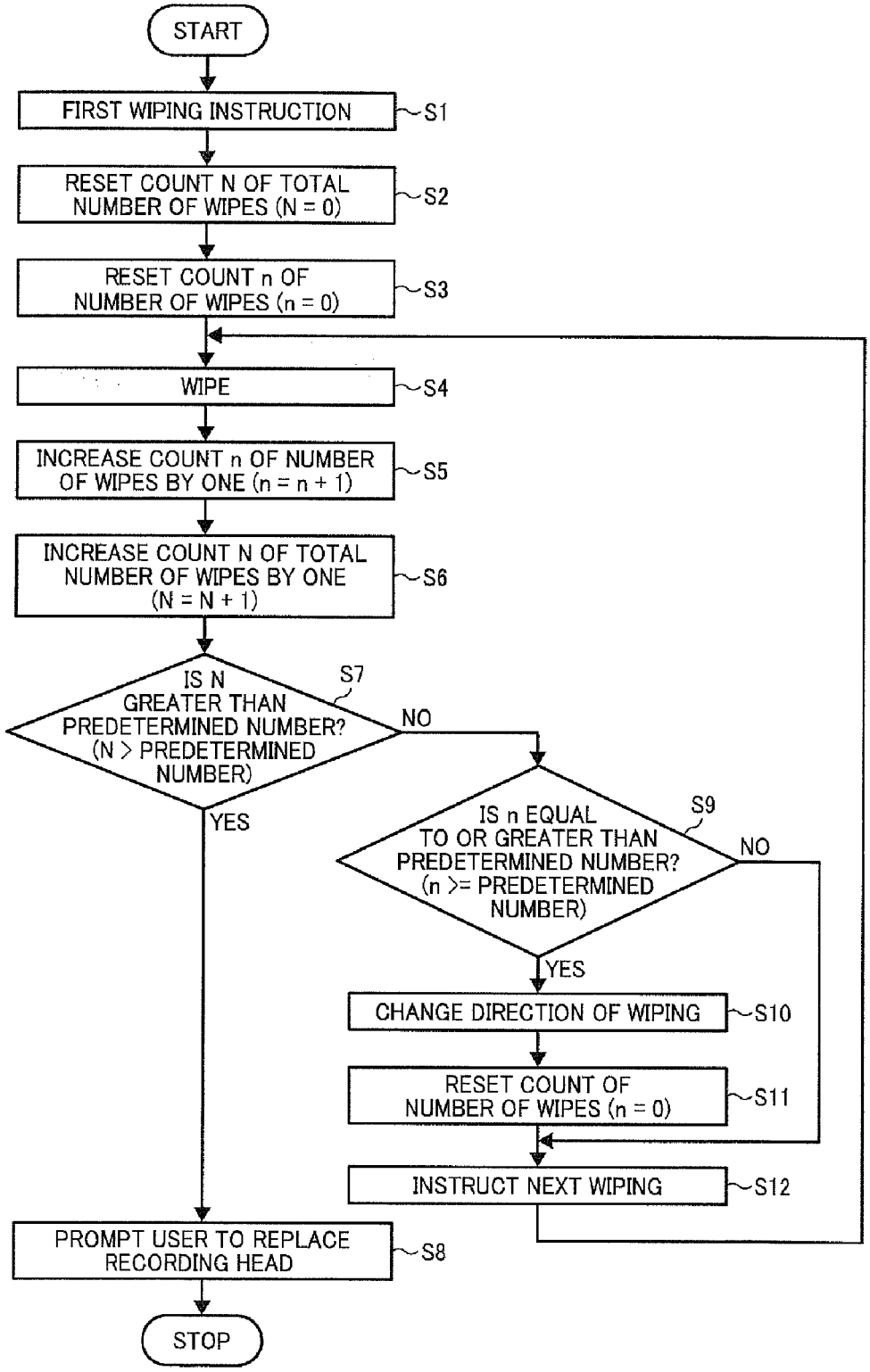
FIG. 13 is a flowchart showing an exemplary procedure of wiping in two directions in the long axis direction of the ink discharge opening according to an illustrative embodiment of the present invention.

Referring now to FIG. 13, there is provided a flowchart showing an exemplary procedure of wiping operation by the wiper blade 283 when the wiping direction thereof includes two directions in the long axis direction of the ink discharge opening of the nozzle.

Figure 19:
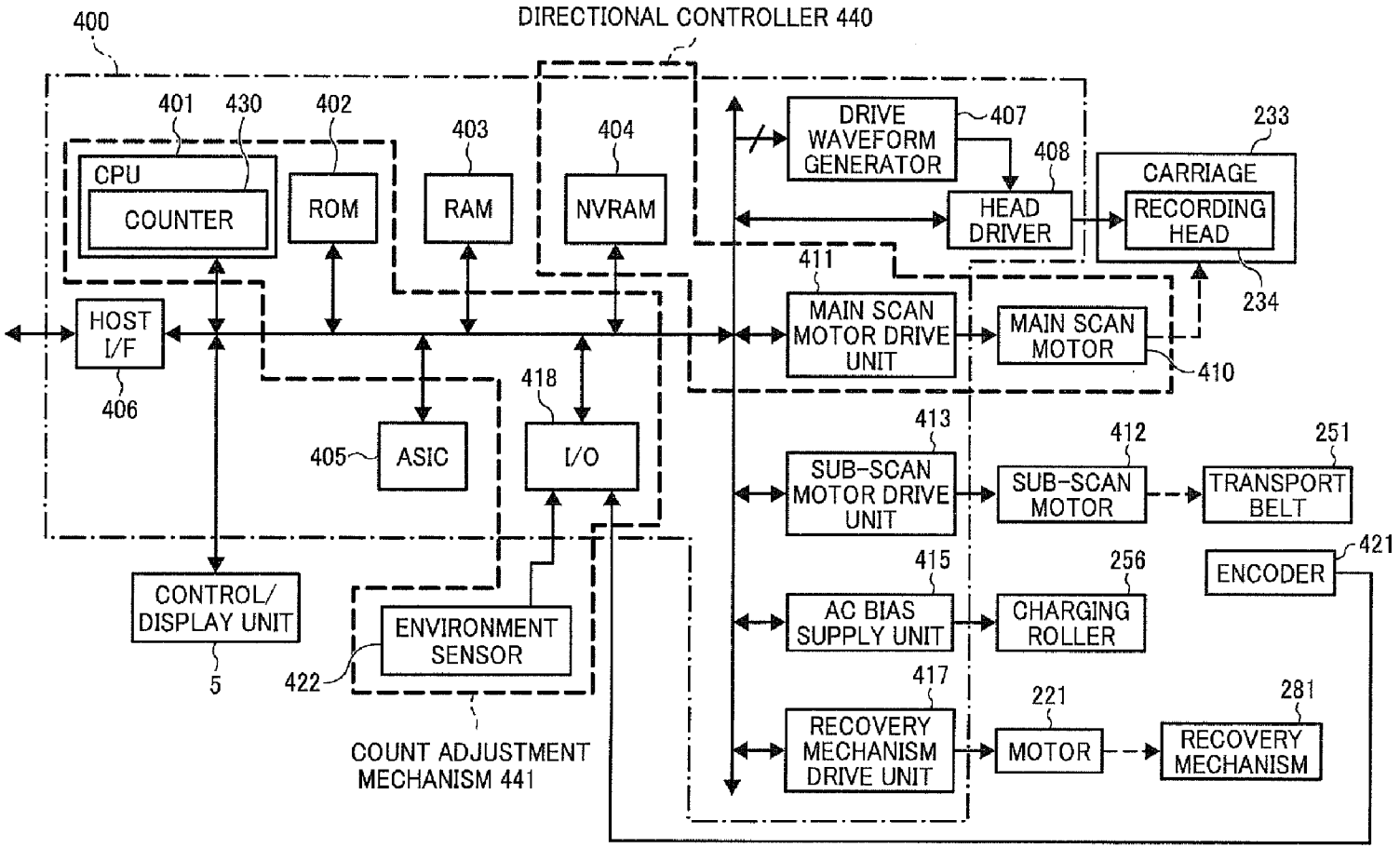
FIG. 19 is a block diagram illustrating a control unit of the image forming apparatus of FIG. 2 according to an illustrative embodiment of the present invention.

According to the illustrative embodiment, the image forming apparatus includes a counter 430 (shown in FIG. 19) and a directional controller 440 (also shown in FIG. 19). The counter 430 obtains a cumulative number of times the wiper blade wipes the nozzle surface. The directional controller 440 (also shown in FIG. 19) changes the moving direction of the wiper blade 283 between a first moving direction and a second moving direction during wiping in accordance with a predetermined cumulative number of wipes.

The directional controller 440 includes a non-volatile memory (herein after referred to as an NVRAM) 404 that stores the cumulative number of wipes and a main scan motor drive unit 411 that drives the main scan motor 410.

The first moving direction is a moving direction of the wiper blade 283 from a first position which is the upstream of the long axis direction of the ink discharge opening to a downstream position, a second position. The second moving direction is a moving direction of the wiper blade 283 that moves from the second position to the first position.

In FIG. 13, at S1 a wiping instruction is sent from the image forming apparatus to a control unit 400 (shown in FIG. 19) in the image forming apparatus. Subsequently, a count N of the total number of wipes is reset at S2, and a count n of the number of wipes is also reset at S3.

After a predetermined wiping operation is performed in accordance with the wiping instruction at S4, the count n of the number of wipes is increased by one in the controller 400 at S5, and the count N of the total number of wipes is also increased by one at S6. This means the cumulative number of wipes is counted.

Next, at S7, the count N of the tonal number of wipes is compared with a predetermined number of wipes which is preset as a number of wipes at or after which the contact angle causes instability of nozzles and thus adversely affects ejection of the ink.

If the count N of the total number of wipes reaches the predetermined number (YES in S7), an operation that prompts a user to replace the recording head is performed at S8, and the image forming apparatus is stopped. An example of the operation that prompts the user to replace the recording head includes, but is not limited to, showing a dialogue on an operation screen, not illustrated, of the image forming apparatus or showing a dialogue on the operation screen of a host computer, not illustrated, connected to the image forming apparatus.

By contrast, if the count N of the total number of wipes does not reach the predetermined number (NO in S7), at S9 the count n of the number of wipes is compared with a predetermined number preset as a number of wipes to be continuously performed without changing the wiping direction.

The predetermined number here is determined depending on the limitations of the apparatus and/or the recovery unit. For example, the predetermined number can be determined to achieve an efficient operation.

If the count n of the number of wipes reaches the predetermined number (YES at S9), the direction of wiping is changed at S10. After the count n of the number of wipes is reset to zero at S11, the next wiping operation is instructed at S12.

By contrast, if the count n of the number of wipes does not reach the predetermined number (NO at S9), the direction of wiping is not changed, and the next wiping operation is instructed at S12.

With this configuration, a speed of deterioration of the ink repellent layer in the vicinity of and at the rim of the ink discharge opening in the moving direction of the wiper blade can be reduced.

Figure 14:
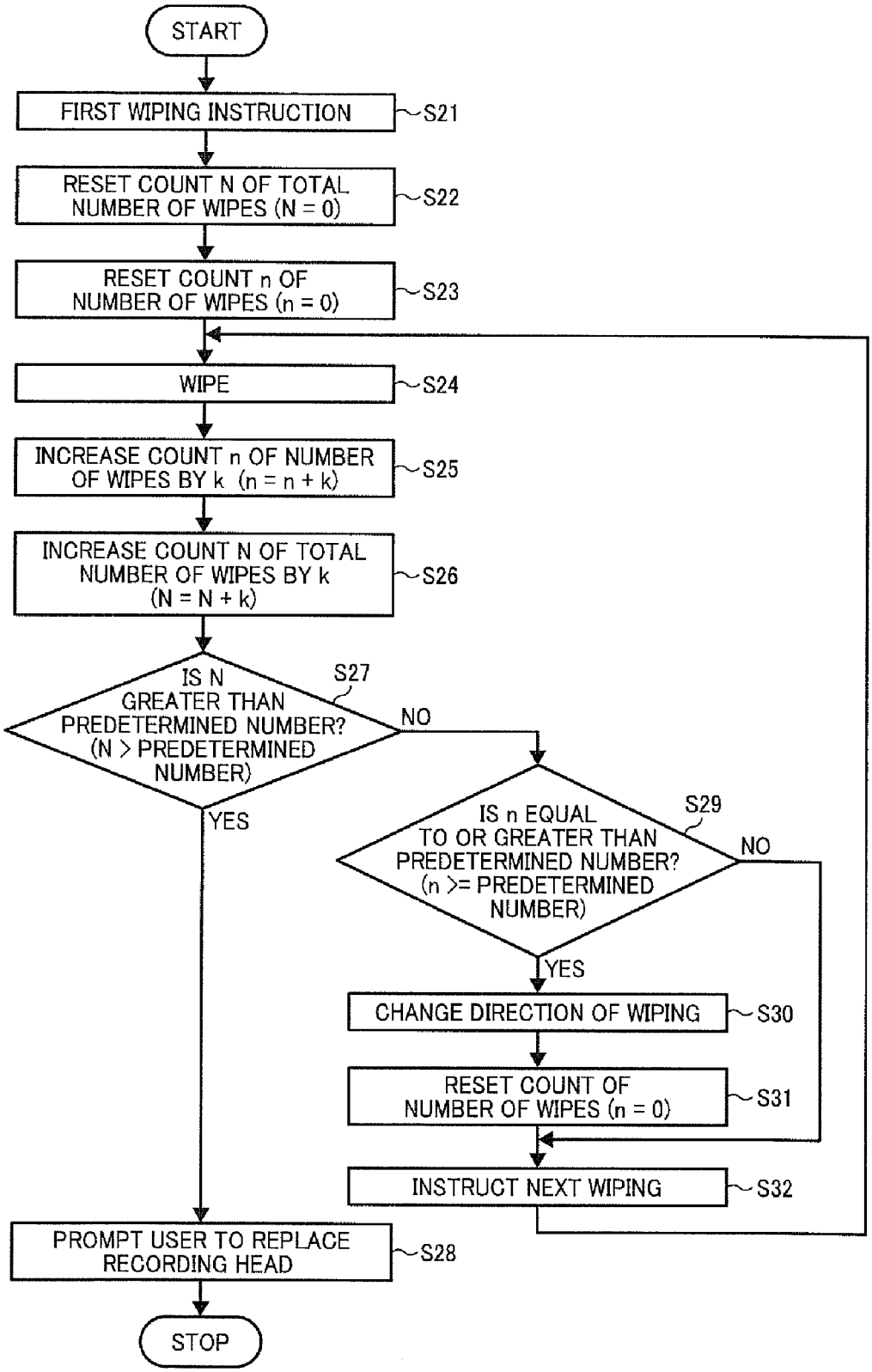
FIG. 14 a flow chart showing an exemplary procedure of another wiping operation in two directions in the long axis direction of the ink discharge opening while environment conditions for the image forming apparatus are taken into consideration according to an illustrative embodiment of the present invention.

Referring now to FIG. 14, there is provided a flow chart showing an exemplary procedure of wiping operation of the wiper blade 283 illustrated in FIG. 12B when environment conditions, for example, temperature and humidity, for the image forming apparatus are taken into consideration and the wiping direction of the wiper blade 283 includes two directions in the long axis direction of the ink discharge opening of the nozzle.

According to the illustrative embodiment, the image forming apparatus includes a count adjustment mechanism 441 (shown in FIG. 19) that adjusts of the count of the number of wipes obtained by the counter 430 in accordance with environmental conditions such as temperature and humidity.

In FIG. 14, at S21, when a wiping instruction is sent from the image forming apparatus to the controller 400 of the image forming apparatus, the count N of the total number of wipes is reset at S22, and the count of the number of wipes is reset at S23.

Subsequently, after a predetermined wiping operation is performed in accordance with the wiping instruction at S24, the count n of the number of wipes is increased in the controller 400 at S25, and the count N of the total number of wipes is also increased at S26. This means the cumulative number of wipes is counted.

When counting the number of wipes at S25 and the total number of wipes at S26, the count of the number of wipes and the count of the total number of wipes are changed, as illustrated in TABLE 1, in accordance with internal conditions of the image forming apparatus. The internal conditions include, for example, temperature and humidity inside the image forming apparatus, in particular, around the recording head 234.

For example, in a dry environment of high temperature and low humidity, ink remaining on the nozzle plate dries easily and agglutinates, thereby producing abrasive particles. As a result, an amount of abrasion per wiping increases as compared with an environment in which ink does not dry easily.

In view of the above, in the environment of high temperature and low humidity, the count of the number of wipes at S25 and the count of the total number of wipes at S26 are raised by two counts (k=2). Accordingly, an error in an amount of abrasion that the controller can comprehend can be reduced, thereby being able to inform the user of an accurate timing at which the head needs to be replaced.

It is to be noted that the count of the number of wipes and the count of the total number of wipes in TABLE 1 is an example. Although variables are indicated in natural numbers, the variables may include real numbers including the decimal point.

In TABLE 1, when the temperature is in a range of 30 to 40 deg. C. (a representative value: 35 deg. C.) for example, it is indicated as "HIGH". When the temperature is in a range of 15 to 30 deg. C. (a representative value: 23 deg. C.) for example, it is indicated as "MIDDLE". When the temperature is in a range of 5 to 15 deg. C. (a representative value: 10 deg. C.) for example, it is indicated as "LOW".

When the humidity is in a range of 70% to 100% (a representative value: 80%) for example, it is indicated as "HIGH". When the humidity is in a range of 30% to 70% (a representative value: 50%) for example, it is indicated as "MIDDLE". When the humidity is in a range of 0% to 30% (a representative value: 10%) for example, it is indicated as "LOW".

TABLE 1

| | HUMIDITY | | | | |
|---|---|---|---|---|---|
| TEMPERATURE | HIGH | → | MIDDLE | → | LOW |
| HIGH | k = 1 | | k = 1 | | k = 2 |
| ↓ | | | | | |
| MIDDLE | k = 1 | | | | |
| ↓ | | | | | k = 1 |
| LOW | | | | | |

Subsequently, at S27 the count N of the total number of wipes is compared with the predetermined number of wipes which is preset as a number of wipes at or after which the contact angle causes instability of nozzles and thus adversely affects ejection of the ink.

If the count N of the total number of wipes reaches the predetermined number (YES in S27), the operation that prompts the user to replace the recording head at S28 is performed, and the image forming apparatus is stopped. An example of the operation that prompts the user to replace the recording head includes, but is not limited to, showing a dialogue on an operation screen, not illustrated, of the image forming apparatus or showing a dialogue on the operation screen of a host computer, not illustrated, connected to the image forming apparatus.

By contrast, if the count N of the total number of wipes does not reach the predetermined number (NO in S27), at S29 the count n of the number of wipes is compared with the predetermined number preset as the number of wipes to be continuously performed without changing the wiping direction.

The predetermined number here is determined depending on the limitations of the apparatus and/or the recovery unit. For example, the predetermined number can be determined to achieve an efficient operation.

If the count n of the number of wipes reaches the predetermined number (YES at S29), the direction of wiping is changed at S30. After the count n of the number of wipes is reset to zero at S31, the next wiping operation is instructed at S32.

By contrast, if the count n of the number of wipes does not reach the predetermined number (NO at S29), the direction of wiping is not changed, and the next wiping operation is instructed at S32.

With this configuration, the amount of abrasion of the ink repellent layer in the vicinity of and at the rim of the ink discharge opening in the moving direction of the wiper blade can be controlled regardless of environmental conditions.

Embodiment 4

Figure 15A:
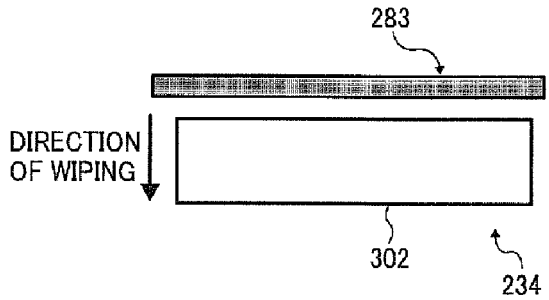
FIG. 15A is a schematic diagram illustrating the wiping direction in a nozzle array direction.
Figure 15B:
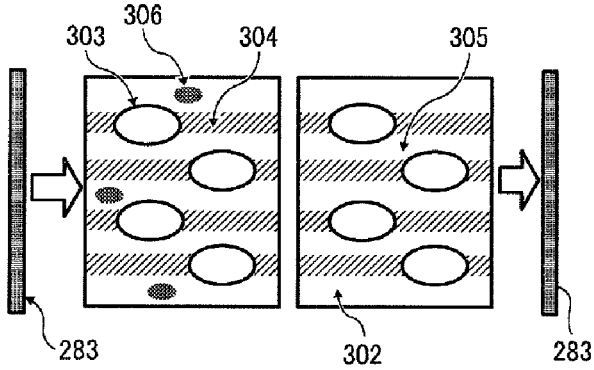
FIG. 15B is a schematic diagram illustrating a high ink repellent region and a low ink repellent region alternately formed in stripes on a nozzle plate.

Referring now to FIGS. 15A and 15B, a description is provided of an example of a nozzle plate 302 including portions having different ink repellent characteristics.

FIG. 15A is a schematic diagram illustrating the wiping direction of the wiper blade 283 relative to the recording head. The wiping direction in FIG. 15A is in the direction of the nozzle array.

According to the illustrative embodiment, when the wiper blade 283 moves in the nozzle array direction, it may be also referred to as horizontal direction wiping.

FIG. 15B is a schematic diagram illustrating a high ink repellent region 304 and a low ink repellent region 305 formed alternately in stripes on the nozzle plate 302. In FIG. 15B, the high ink repellent region 304 of maximum ink repellency and the low ink repellent region 305 are formed alternately in stripes on the nozzle plate 302 in the direction perpendicular to the wiping direction of the wiper blade 283 (the longitudinal direction of the wiper blade 283) on the nozzle plate 302. In particular, the high ink repellent region 304 is formed over the portion of a nozzle 303 having a large curvature, that is, the short side of the oval nozzle.

When the high ink repellent region 304 and the low ink repellent region 305 are provided alternately on the nozzle plate 302 as illustrated in FIG. 15B, even if the ink remains on the nozzle plate 302 for some reason, the ink remains more easily on the low ink repellent region 305 than the high ink repellent region 304.

Figure 16A:
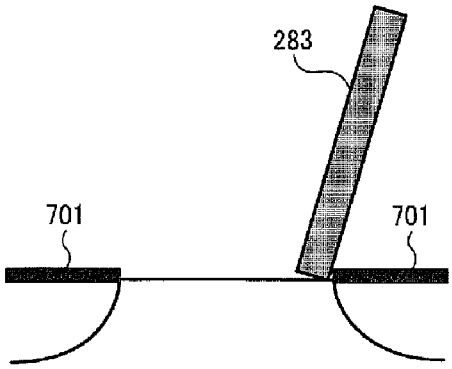
FIG. 16A is a schematic diagram illustrating the wiper blade without residual ink.
Figure 16B:
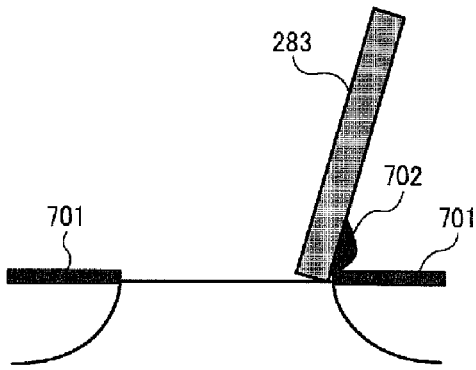
FIG. 16B is a schematic diagram illustrating the wiper blade with residual ink.

Therefore, even if ink residue 306 is dried and agglutinated on the nozzle plate 302, the wiper blade 283 is prevented from rubbing agglutinated ink 702 such as shown in FIG. 16B against a portion of the nozzle plate that needs to be protected from abrasion while wiping. In other words, as illustrated in FIG. 16A, while wiping, the wiper blade 283 is prevented from rubbing the agglutinated ink against an ink repellent layer 701 around the nozzle edge of the ink discharge opening having a large curvature.

As a result, as illustrated in FIG. 16A, the wiper blade 283 can wipe the nozzle plate without rubbing the agglutinated ink 702 against the ink repellent layer 701 around the nozzle edge of the ink discharge opening having a large curvature.

Embodiment 5

Figure 17A:
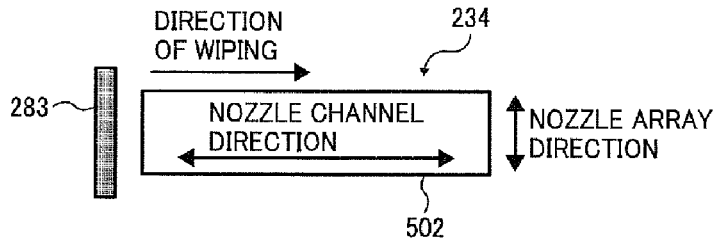
FIG. 17A is a schematic diagram illustrating the wiping direction in the direction of a nozzle channel.
Figure 17B:
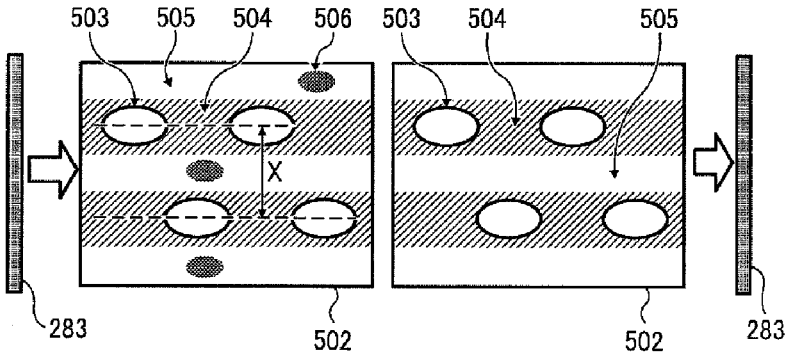
FIG. 17B is a schematic diagram illustrating the high ink repellent region and the low ink repellent region alternately formed in stripes in the direction perpendicular to the wiping direction.

Referring now to FIGS. 17A and 17B, a description is provided of another example of a nozzle plate including regions having different ink repellent characteristics. In FIGS. 17A and 17B, a nozzle plate 502 includes portions having different ink repellent characteristics.

FIG. 17A is a schematic diagram illustrating the wiping direction of the wiper blade 283 relative to the recording head 234. The wiping direction of the wiper blade 283 according to the illustrative embodiment is a nozzle channel direction orthogonal to the nozzle array direction. According to the illustrative embodiment, when the wiper blade 283 moves in the nozzle channel direction, it is also referred to as vertical direction wiping.

When one nozzle array consists of m number of nozzles arranged in the nozzle array direction, a nozzle channel refers to nozzles arranged in a row orthogonal to the nozzle array direction, and m number of nozzle channels are provided in the recording head.

FIG. 17B is a schematic diagram illustrating a high ink repellent region 504 and a low ink repellent region 505 formed alternately in stripes on the nozzle plate 502. In FIG. 17B, the high ink repellent region 504 and the low ink repellent region 505 are formed alternately in stripes on the nozzle plate 502 in the direction perpendicular to the wiping direction of the wiper blade 283 (the longitudinal direction of the wiper blade 283) on the nozzle plate 502. In particular, the high ink repellent region 504 is formed over the portion of a nozzle 503 having a larger curvature, that is, the short side of the oval nozzle.

According to the foregoing embodiment, as illustrated in FIG. 15A, the direction of wiping of the wiper blade 283 is in the nozzle array direction (horizontal direction wiping). By contrast, according to the present embodiment, the direction of wiping of the wiper blade 283 is in the direction of the nozzle channel (vertical direction wiping) as illustrated in FIG. 17A.

According to the present embodiment, when the area of the opening of the nozzles (the ink discharge opening of the nozzles), the total number of nozzles (the ink discharge opening of the nozzles), and the number of nozzles (the ink discharge opening of the nozzles) per nozzle array are the same, if the wiper blade wipes in the nozzle channel direction, a distance X between adjacent portions of the nozzles 503 in the nozzle array direction, in particular, between adjacent portions of the short side of the oval nozzles having the large curvature can be extended as compared with a case in which the wiper wipes in the nozzle array direction according to the foregoing embodiment.

According to the present embodiment, when wiping in the nozzle channel direction, a large area of the high ink repellent region 504, on which the residual ink 506 is prevented from staying, can be provided and the entire discharge opening of the nozzle 503 can be formed within the high ink repellent region 504 while securing the low ink repellent region, as compared with wiping in the nozzle array direction as shown in FIGS. 15A and 15B. In the foregoing embodiment, if the high ink repellent region is provided to cover the entire ink discharge opening, the low ink repellent region cannot be formed.

With this configuration, the wiper blade 283 is less likely to rub the agglutinated ink, which is a product of dried residual ink, against the entire periphery of the ink discharge opening of the nozzles, resulting in stability of the nozzles and enabling stable ink ejection from the ink discharge opening of the nozzles.

Embodiment 6

Figure 18A:
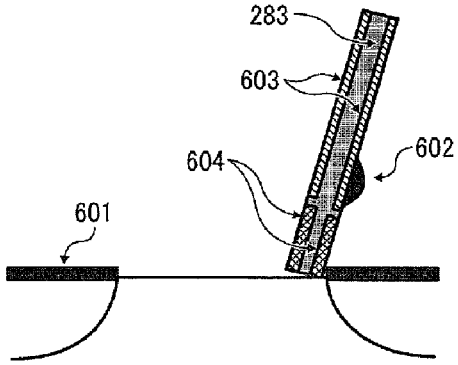
FIG. 18A is a side schematic view of the movement of the wiper blade.
Figure 18B:
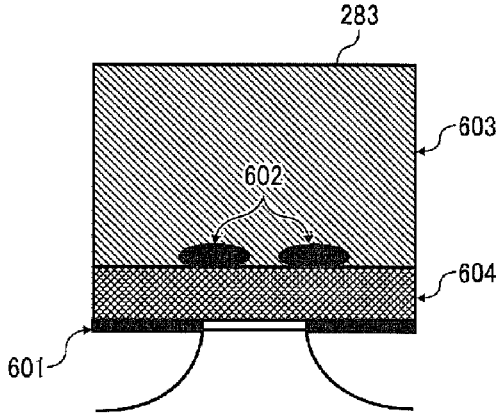
FIG. 18B is a front view of the movement of the wiper blade.

Referring now to FIGS. 18A and 18B, a description is provided of the wiper blade 283 including portions having different ink repellent characteristics.

FIG. 18A is a side schematic view of movement of the wiper blade 283. FIG. 18B is a front schematic view of the wiper blade 283.

As illustrated in FIGS. 18A and 18B, a high ink repellent region 604 is provided on and in the vicinity of both sides of the wiper blade 283 in the direction of wiping that slidably contacts an ink repellent layer 601 around the nozzle edge.

Substantially above the high ink repellent region 604 (in the direction separating from the nozzle plate), the low ink repellent region 603 is provided.

When the high ink repellent region 604 and the low ink repellent region 603 are formed on both sides of the wiper blade 283 in the direction of wiping as illustrated in FIGS. 18A and 18B, residual ink 602 remaining on the high ink repellent region 604 on the wiper blade 283 can be transferred to the low ink repellent region 603 by wiping. In other words, the residual ink 602 can be removed from a contact portion of the wiper blade 283 that frictionally contacts the ink repellent layer 601 around the nozzle edge, thereby reducing, if not preventing entirely, the agglutinated ink residue adhering to the wiper blade 283 from rubbing against the periphery of the nozzle edge of the ink discharge opening of the nozzles. Accordingly, the nozzle can be reliably stabilized, thereby enabling stable ink ejection for an extended period of time.

According to the illustrative embodiment, the nozzle plate is formed by nickel electroforming or the like. The nozzle surface on the nozzle plate, that is, the surface on which the ink discharge opening is formed, includes the ink repellent layer formed of a water-shedding film including silicone resin or the like. When the ink repellent layer is worn out, this means that the ink repellent layer is removed from the nozzle plate and the surface of the nozzle plate itself appears.

Referring now to FIG. 19, there is provided a block diagram illustrating a control unit of the image forming apparatus. A control unit 400 includes a CPU 401, a ROM 402, a RAM 403, a non-volatile memory 404, and an ASIC 405. The CPU 401 controls the image forming apparatus. The ROM 402 stores various data such as drive waveform data, a predetermined threshold value of the number of wipes for changing the direction of wiping in accordance with environmental conditions such as temperature, and other fixed data. The RAM 403 temporarily stores image data and so forth. The NVRAM 404 retains data while the power of the apparatus is off. The ASIC 405 carries out various signal processing relative to image data, image processing including sorting, and input/output signal processing for controlling the image forming apparatus.

The control unit 400 includes an I/F 406, a drive waveform generator 407, a head driver 408, a main scan motor drive unit 411, a sub-scan motor drive unit 413, an AC bias supply unit 415, a recovery mechanism drive unit 417, an encoder 421, and an I/O 418.

Data and signals are transmitted and received through the I/F 406. The drive waveform generator 407 generates the drive waveform for controlling a pressure generator of the recording head 234. The main scan motor drive unit 411 drives the main scan motor 410. The sub-scan motor drive unit 413 drives the sub-scan motor 412. The AC bias supply unit 415 supplies an AC bias to the charging roller 256. The recovery mechanism drive unit 417 drives a motor 221 that drives the recovery mechanism 281. The encoder 421 outputs detection signals according to an amount of travel and a traveling speed of the transport belt 251. Detection signals provided by various sensors are input by the I/O 418.

A control/display unit 5 is connected to the control unit 400 so that information necessary for the operation of the image forming apparatus can be input through and displayed on the control/display unit 5.

The CPU 401 includes the counter 430 that calculates the cumulative number of wipes. The counter 430 of the CPU 401 counts the cumulative number of wipes by the wiper blade 283 of the recovery mechanism 281 and stores the result of counting in the NVRAM 404.

Subsequently, the CPU 401 analyses the result, and if necessary, the directional controller 440 including the NVRAM 404 and the main scan motor drive unit 411 for driving the main scan motor 410 controls the carriage 233 to change the moving direction of the wiper blade 283. In the meantime, the CPU 401 controls the recovery mechanism drive unit 417 such that the wiper blade 283 wipes in the direction that is changed.

Furthermore, in order to accommodate environmental conditions, the CPU 401 analyzes information from the I/O 418 to which the detection signal provided by an environment sensor 422 has been input. If necessary, the count adjustment mechanism 441 changes the calculation method for calculating the cumulative wiping number in the CPU 401 using the predetermined value stored in the ROM 402.

According to the illustrative embodiment, the count adjustment mechanism 441 includes the CPU 401, the ROM 402, the I/O 418, and the environment sensor 422.

The I/F 406 of the control unit 400 receives print data and so forth through a cable or the Net from a host machine such as an information processor, i.e., a personal computer, an image reading device such as an image scanner, and an imaging device such as a digital camera. Subsequently, the CPU 401 reads out and analyzes the print data in a receive buffer in the I/F 406. In the ASIC 405 image processing, sorting of data, and so forth are performed. The CPU 401 sends the image data (dot pattern data) for one line of the recording head 234 in a form of serial data to the head driver 408 synchronously with a clock signal. Furthermore, a latch signal and a control signal are also sent to the head driver 408 at a predetermined timing.

Subsequently, the CPU 401 reads out and analyzes the print data in the receive buffer in the I/F 406. In the ASIC 405 image processing, sorting of data, and so forth are performed. The CPU 401 transfers the image data to the head driver 408.

It is to be noted that the dot pattern data for outputting the image is generated by storing font data in the ROM 402, for example. Alternatively, the image data is expanded in a form of bitmap data by a printer driver of the host machine and transferred to the head driver 408.

The drive waveform generator 407 includes at least a digital-analogue (D/A) converter that converts the pattern data of the drive waveform to an analogue signal. The drive waveform generator 407 outputs the drive waveform consisting of a single drive pulse (drive signal) or a plurality of the drive pulses (drive signals) to the head driver 408.

The head driver 408 drives the recording head 234 by selectively applying the drive pulse constituting the drive waveform provided by the drive waveform generator 407 to a pressure generator of the recording head 234 based on the serial-input image data (dot pattern data) corresponding to one line of the recording head 234.

The control unit 400 controls ON and OFF of an AC bias supplied from the AC bias supply unit 415 to the charging roller 256 so as to regulate a charging pattern (an amount of applied charge) on the transport belt 251.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a recording head;

a nozzle provided in the recording head, the nozzle including an ink discharge surface including a substantially elongated opening from which ink is ejected;

an ink repellent layer formed on the ink discharge surface of the nozzle; and an elastic wiper blade that moves over the ink discharge surface to wipe away ink adhering to the ink discharge surface while slidably contacting the ink discharge surface, the wiper blade moving in a long axis direction of the ink discharge opening as the wiper blade wipes away ink adhering to the ink discharge surface of the nozzle.

2. The image forming apparatus, according to claim 1, further comprising:

a counter to track a number of times the wiper blade wipes the ink discharge surface of the nozzle; and a directional controller that changes a direction of movement of the wiper blade between a first direction and a second direction as the wiper blade wipes away ink adhering to the discharge surface of the nozzle depending on a cumulative number of times the wiper blade wipes the ink discharge surface of the nozzle as counted by the counter, wherein the first direction is a direction from an upstream of the long axis direction of the ink discharge opening to a downstream thereof, and the second direction is a reverse direction of the first direction.

3. The image forming apparatus, according to claim 1, wherein the ink discharge surface has different ink repellent characteristics in a direction perpendicular to the moving direction of the wiper blade, including a portion of maximum ink repellency provided at least a portion of the ink discharge surface including a portion of the ink discharge opening in the long axis direction of the ink discharge opening.

4. The image forming apparatus according to claim 3, wherein the recording head includes a plurality of nozzles arrayed in an nozzle array direction and forming nozzle channels in a nozzle channel direction orthogonal to the nozzle array direction, and the moving direction of the wiper blade as the wiper blade wipes away ink adhering to the discharge surface of the nozzle coincides with the nozzle channel direction.

5. The image forming apparatus according to claim 1, wherein side surfaces of the wiper blade in the moving directions have different ink repellent characteristics, including portions of high ink repellency where the side surfaces of the wiper blade contact the ink repellent layer formed on the ink discharge surface of the nozzle in the vicinity of the ink discharge opening as the wiper blade wipes away ink adhering to the discharge surface of the nozzle.

6. The image forming apparatus according to claim 2, further comprising a count adjustment mechanism that adjusts the count of the number of times the wiper blade wipes the ink discharge surface of the nozzle as counted by the counter in accordance with certain predetermined environmental variables.

7. The image forming apparatus according to claim 6, where the variables are at least one of temperature and humidity.

* * * * *